United States Patent [19]

Mason

[11] Patent Number: 5,050,750

[45] Date of Patent: Sep. 24, 1991

[54] SHELF-SUPPORTING CLOSET CLOTHES RACK

[76] Inventor: Roland V. Mason, 239 Carmel Dr., Lot 5, Fort Walton Beach, Fla. 32548

[21] Appl. No.: 631,997

[22] Filed: Dec. 21, 1990

[51] Int. Cl.[5] ..... A47F 5/00

[52] U.S. Cl. ..... 211/123; 211/105.1

[58] Field of Search ..... 211/123, 113, 94, 86, 211/162, 105.1

[56] References Cited

U.S. PATENT DOCUMENTS

| | | | |
|---|---|---|---|
| 3,120,309 | 2/1964 | Goettl et al. | 211/123 |
| 3,688,915 | 9/1972 | Ramsey | 211/123 |
| 4,671,419 | 6/1987 | Beverly | 211/123 X |
| 4,953,718 | 9/1990 | Graff et al. | 211/123 |

*Primary Examiner*—Robert W. Gibson, Jr.

*Attorney, Agent, or Firm*—George A. Bode; Michael L. Hoelter

[57] ABSTRACT

A clothes hanging apparatus is secured to the underneath of the shelf in a closet to provide additional rigidity to the shelf and to provide a hanger for suspending clothes therefrom. This clothes hanging apparatus is generally secured to the underneath of the shelf by a series of intermediately located mechanical fasteners, but other fasteners are equally suitable. As a result, this apparatus may be secured to a mid-region of the shelf; it need not extend the entire length of the shelf as other systems require. Additionally, this apparatus is preferably of unitary construction and of uniform composition.

18 Claims, 3 Drawing Sheets

SHELF-SUPPORTING CLOSET CLOTHES RACK

BACKGROUND OF THE INVENTION

1. Field of the Invention

The present invention pertains to an apparatus for hanging clothes and more specifically to an apparatus for supporting clothes hangers hung in a closet under a shelf.

2. General Background

Generally, the typical home clothes closet consists of a shelf and a metal rod supported below this shelf for hanging clothes therefrom. As is often the case, the shelf becomes overloaded resulting in a mid-span sag. If the sag becomes too great, the shelf breaks. If the shelf does not fail, it may contact or engage the rod underneath thereby diminishing its capability to suspend clothes therefrom. Alternately, if the span of the shelf is to long, then even if it is not over-loaded, it will still sag.

Another factor regarding closet storage systems is the fact that the metal rod supporting the clothes is often itself only supported by drywall materials. As is well known, drywall material is not very strong and cannot support very heavy loads. Preferably, the metal rod is connected to the support studs in the opposite walls of the closet, but this is not always possible should the owner desire to remodel the closet or relocate the metal rod. In these instances, the owner would need to remove large sections of the drywall material so as to properly secure the metal rod to the support studs. This, as can be surmised, is both costly and time consuming.

Still another drawback to the metal rod as a suitable clothes hanger is the fact that it must be supported near its end regions thereby requiring a means for providing such support. Should an owner desire to reduce the span of the metal rod to only a mid-region of a closet, he or she must then provide sufficient support for this rod in this region which may offset or spoil the layout or design of the rest of the closet.

It is thus an object of this invention to provide an apparatus that will stiffen or brace the overhead shelf so as to prevent it from sagging. Another object of this invention is to provide a clothes support from which clothes may be hung. Still another object of this invention is to provide a means for hanging clothes in the event no end support are available. These and other objects will become obvious upon further investigation.

SUMMARY OF THE PRESENT INVENTION

The preferred embodiment of the apparatus of the present invention solves the aforementioned problems in a straight forward and simple manner. What is provided is a clothes hanging apparatus comprising an elongated base plate having a relatively planar upper surface that engages the underneath side of a shelf. This apparatus incorporates stiffening means that provide rigidity to both the apparatus and the shelf to which it is attached. A clothes hanger support is suspended from this base plate by suspending means with this support being, of course, sized in accordance with the curvature of the typical clothes hanger.

BRIEF DESCRIPTION OF THE DRAWING

For a further understanding of the nature and objects of the present invention, reference should be had to the following description taken in conjunction with the accompanying drawing in which like parts are given like reference numerals and, wherein.

DETAILED DESCRIPTION OF THE PREFERRED EMBODIMENT

Figure 1:
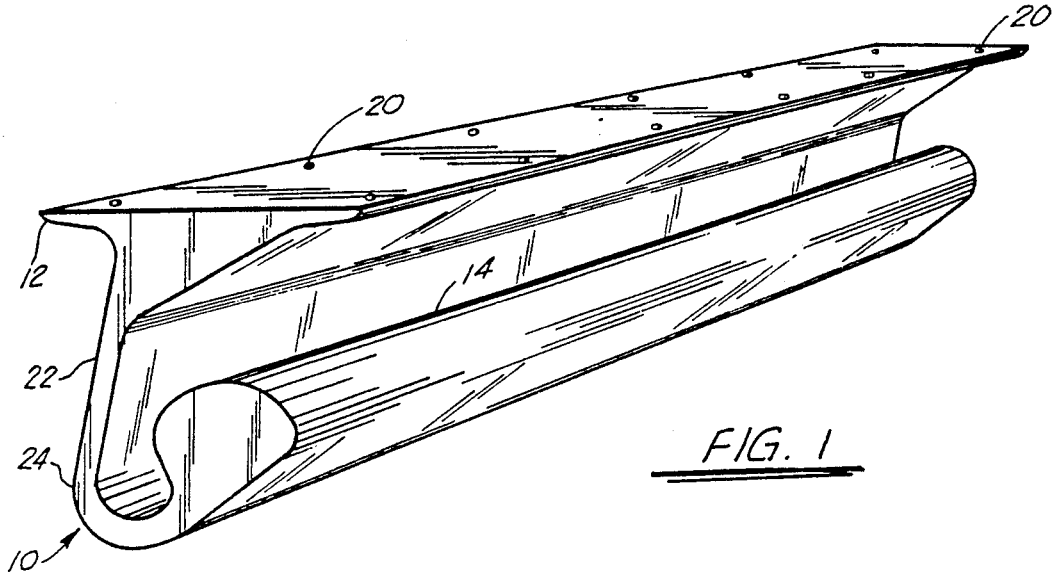
FIG. 1 is a top perspective view of the preferred embodiment of the apparatus of the present invention.
Figure 8:
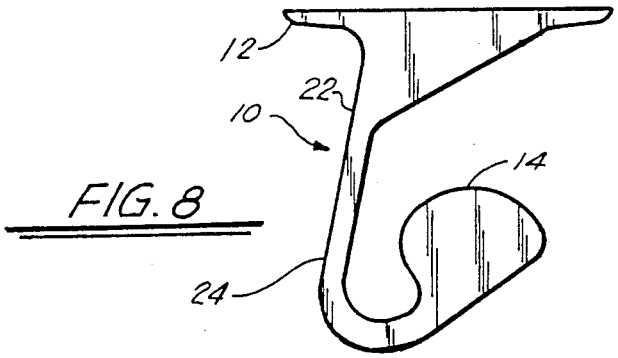
FIG. 8 is a side view of the embodimemt of FIG. 1.
Figure 9:
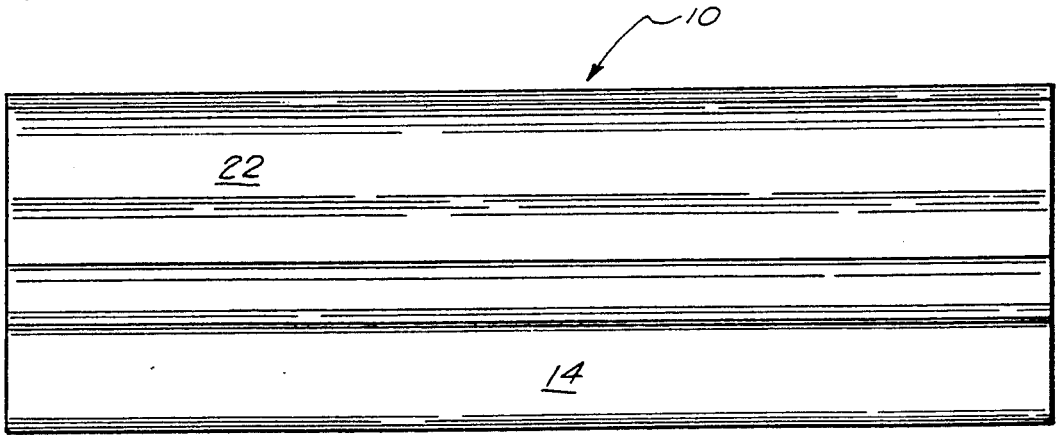
FIG. 9 is a front elevational view of the embodiment of FIG. 1.

Referring now to the drawing, and in particular FIGS. 1, 2, 7, 8 and 9, the apparatus of the present invention is designated generally by the numeral 10. Apparatus 10 is preferably of unitary construction and comprises a base 12 from which hanger support 14 is suspended. The upper portion of base 12 is flat or planar so that it can be fastened, such as by mechanical fasteners 16, to the underneath side of shelf 18. To accommodate these fasteners 16, base 12 is designed incorporating a multitude of openings or holes 20 therein.

The underneath side of base 12 is configured so as to support hanger support 14 therefrom. Such support 14, in this embodiment, comprises a thick stiffening portion 22 tapering downward from base 12 as best seen in FIGS. 1, 2, 7 and 8. This stiffening portion or stiffener 22 provides rigidity to both shelf 18 and clothes rack 10. In the preferred embodiment, stiffener 22 imparts an approximately 2° upward curvature to clothes rack 10 so as to allow for a 2° sag when loaded. As stiffener 22 narrows, a thinner span 24 of this material extends downwardly therefrom. This span 24 continues downward a slight distance before it begins to gently curve around and start upward. At this point, span 24 expands into bulbaceous hanger support 14 as shown.

The rise and curvature of hanger support 14 is, of course, designed to closely accommodate the curvature found in most clothes hangers 26. The rise of hanger support 14 is important so that end 28 of each clothes hangers 26 does not "bottom out" or engage span 24 (see FIG. 2). Also, the curvature of hanger support 14 is important so that each clothes hanger 26 is properly supported and does not slip while being so supported. It is also important that the configuration and cross-section of hanger support 14 remain constant so that the various clothes hangers 26 supported therefrom can slide along the length of hanger support 14 without any obstruction or interference.

Preferably, clothes rack 10 is constructed of a single material, this material may be a metal such as extruded aluminum, or it may be fiberglass, or it may be a petroleum distillate such as nylon or plastic. Other compositions may work as well so long as the physical properties include some degree of rigidity. Additionally, it is preferred to construct clothes rack 10 as a single unit rather than as a composition of smaller, individual units so as to improve upon the rigidity and strength of clothes rack 10. However, this is not to say that clothes rack 10 cannot be constructed of dissimilar materials and of separate parts. It is also possible to construct clothes rack 10 in a variety of colors, if such becomes desirable.

Figure 3:
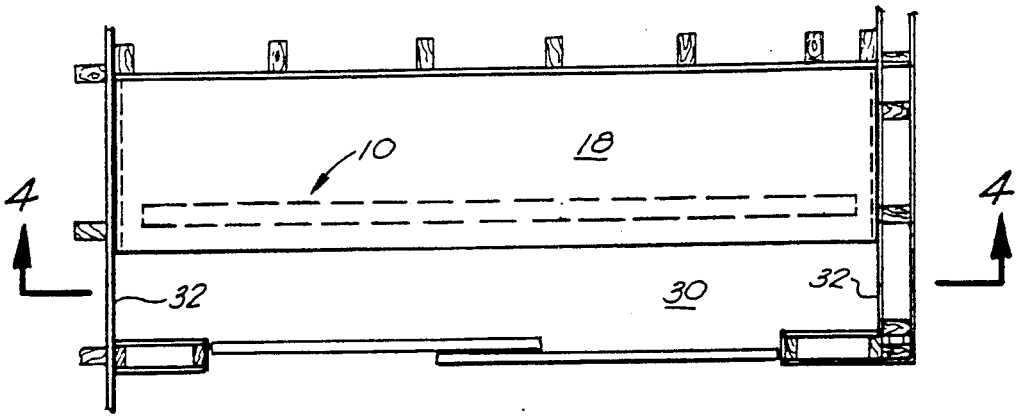
FIG. 3 is a top view of a typical closet illustrating the preferred placement of the embodiment of FIG. 1.
Figure 4:
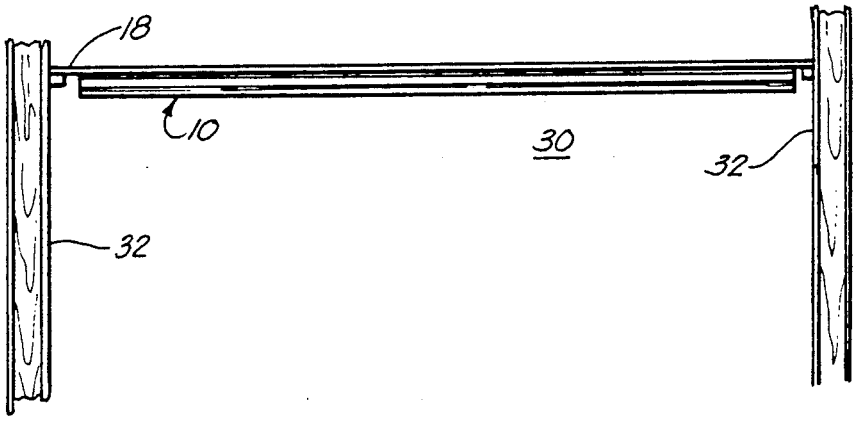
FIG. 4 is a sectional view taken along lines 4—4 of FIG. 3.

Referring now to FIGS. 3 and 4, there is shown typical closet 30 with overhead shelf 18. As can be seen, clothes rack 10 is secured underneath shelf 18 and due to stiffener 22, shelf 18 is reinforced along its length so as to reduce its sagging when loaded. Also, should the owners of closet 30 desire to limit or reduce the length of hanger support 14, they can easily trim or cut clothes rack 10 to the proper length without also having to support each end as would be required if a metal pipe were used.

Figure 5:
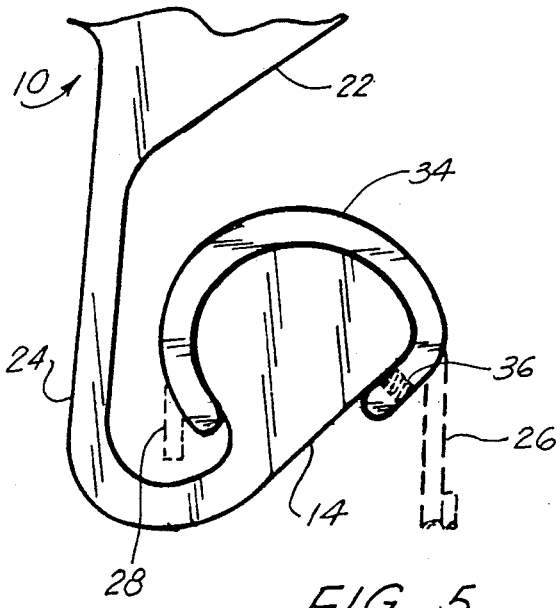
FIG. 5 is an enlarged side view, partially broken away of the embodiment of FIG. 1, illustrating the addition of the end stop.
Figure 6:
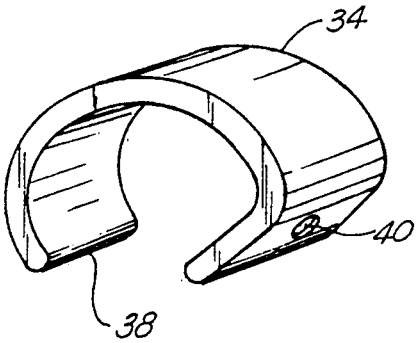
FIG. 6 is a top perspective view of the end stop.
Figure 2:
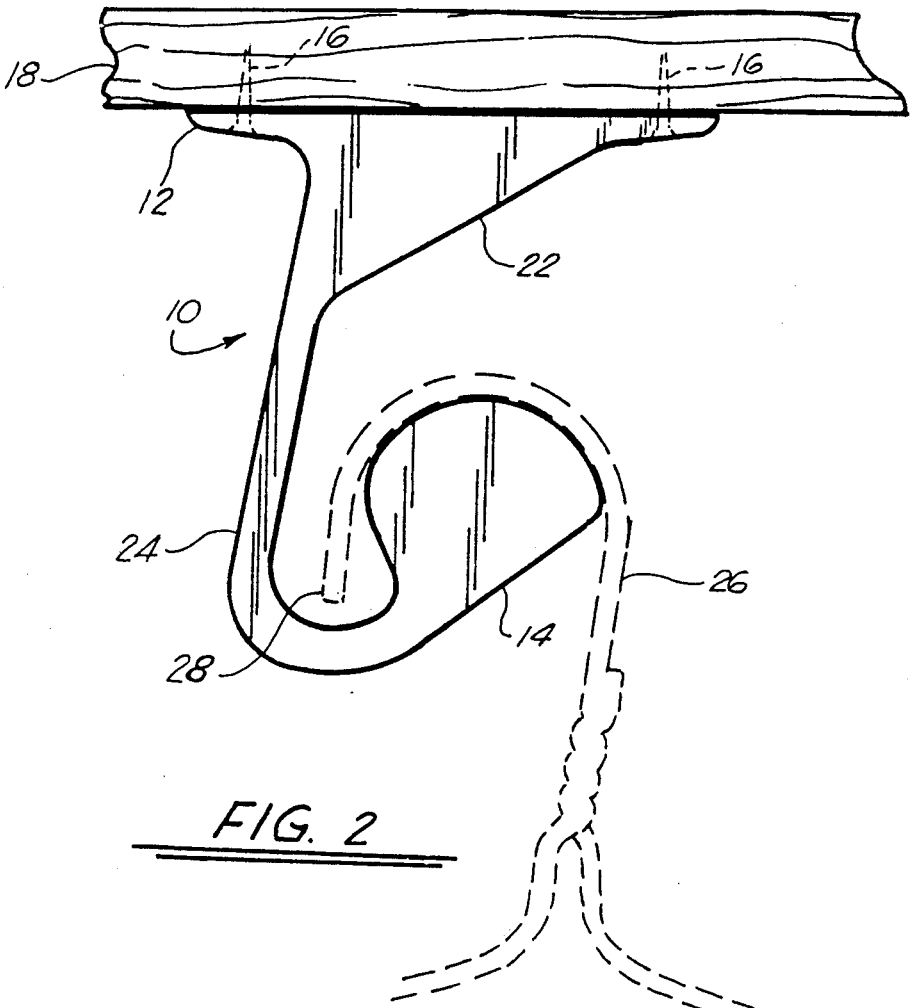
FIG. 2 is a side view of the embodiment of FIG. 1 attached to a partially broken away shelf and illustrating a clothes hanger (in phantom) suspended therefrom.
Figure 7:
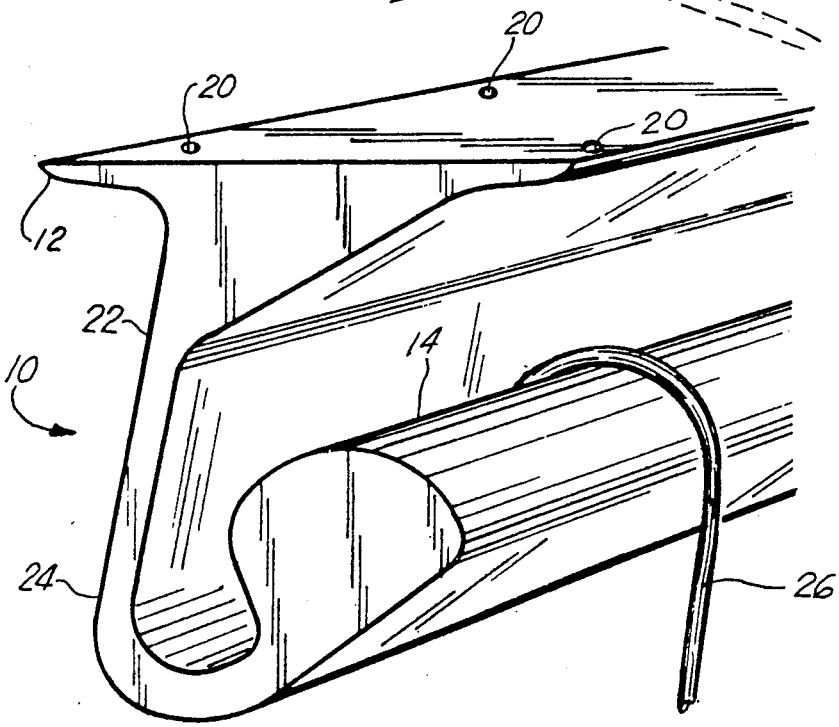
FIG. 7 is a partial top perspective view of one end of the embodiment of FIG. 1 illustrating the top portion of a clothes hanger suspended therefrom.

In the event clothes rack 10 does not extend to the end of closet 30 or does not abut drywall 32 or a vertical shelving unit, then end stops 34 (FIGS. 5) and 6) are to be incorporated so as to prevent clothes hangers 26 from sliding off the ends of clothes rack 10. Generally, each end stop 34 is fastened to clothes rack 10 by set screw 36, however, another type fastener may also be used. It is also possible for end stop 34 to be clamped or wedged onto hanger support 14 if so desired.

In this embodiment, end stop 34 consists of a singular piece of material, not unlike the composition of clothes rack 10, that is bent or curved almost into a closed loop. The open or incomplete region 38 of end stop 34 is sized to accommodate span 24 so that it can be slipped onto hanger support 14. Opening 40 in end stop 34 is normally threaded so as to accommodate set screw 36. In this fashion, end stop 34 can be inserted anywhere along the length of hanger support 14 as needed or desired; it is not limited to only the end regions.

Because many varying and differing embodiments may be made within the scope of the inventive concept herein taught and because many modifications may be made in the embodiment herein detailed in accordance with the descriptive requirement of the law, it is to be understood that the details herein are to be interpreted as illustrative and not in a limiting sense.

What is claimed as invention is:

1. A clothes hanging apparatus comprising:

(a) an elongated base plate having a relatively planar upper surface and a plurality of openings therethrough;

(b) longitudinal stiffening means forming a part of and positioned on an underneath side of said base plate for imparting longitudinal rigidity to said base plate;

(c) a clothes hanger support means suspended from said base plate, the upper perimeter of said clothes hanger support means being configured to accommodate the curvature of a plurality of clothes hangers; and, (d) means for suspending said clothes hanger support from said base plate.

2. The apparatus of claim 1, wherein said clothes hanging apparatus is of unitary construction.

3. The apparatus of claim 2, wherein said longitudinal stiffening means comprises an enlarged area of said base plate.

4. The apparatus of claim 3, wherein said enlarged area is, in cross-section, in a mid-region of said base plate.

5. The apparatus of claim 3, wherein said longitudinal stiffening means tapers downward to said suspending means.

6. The apparatus of claim 5, wherein said suspending means initially extends downwardly a slight distance, but eventually curves upward towards said clothes hanger support.

7. The apparatus of claim 6, wherein said suspending means expands at its end region to form said clothes hanger support.

8. The apparatus of claim 7, further comprising an end stop to prevent said clothes hangers from sliding off said clothes hanger support means.

9. The apparatus of claim 8, wherein said end stop is fastened to said clothes hanger support.

10. The apparatus of claim 8, wherein said longitudinal stiffening means increases the rigidity of the shelf to which said clothes hanging apparatus is fastened.

11. The apparatus of claim 10, wherein said clothes hanging apparatus is of uniform composition.

12. The apparatus of claim 11, wherein said clothes hanging apparatus is constructed of a metal material.

13. The apparatus of claim 11, wherein said clothes hanging apparatus is constructed of plastic, nylon or other petroleum derivative.

14. A clothes hanging apparatus comprising:

(a) an elongated plate having a planar upper surface and an enlarged longitudinal stiffening region underneath;

(b) a clothes hanger support means configured to support a plurality of clothes hangers therefrom, said clothes hanger support means being suspended underneath said elongated plate;

(c) suspending means for suspending said clothes hanger support means underneath said elongated plate; and, (d) end stops secured to said clothes hanger support for containing said clothes hangers said clothes hanger support means.

15. The apparatus of claim 14, further comprising a plurality of openings in said elongated plate for mounting said clothes hanging apparatus to an overhead support.

16. The apparatus of claim 15, wherein said clothes hanging apparatus is secured to the underneath side of a shelf.

17. The apparatus of claim 16, wherein said clothes hanging apparatus is of unitary construction and of uniform composition.

18. The apparatus of claim 17, wherein said end stops are secured to the opposite end regions of said clothes hanger support means.

* * * * *